US006672577B2

(12) United States Patent
Murvine

(10) Patent No.: US 6,672,577 B2
(45) Date of Patent: Jan. 6, 2004

(54) WORK HOLDING TOOL SYSTEM

(76) Inventor: Judith L. Murvine, 22610 285th Ave. SE., Maple Valley, WA (US) 98038-6906

( * ) Notice: Subject to any disclaimer, the term of this patent is extended or adjusted under 35 U.S.C. 154(b) by 0 days.

(21) Appl. No.: 10/192,814

(22) Filed: Jul. 9, 2002

(65) Prior Publication Data

US 2003/0020224 A1 Jan. 30, 2003

Related U.S. Application Data

(60) Provisional application No. 60/308,548, filed on Jul. 27, 2001.

(51) Int. Cl.[7] ..... B25B 1/20
(52) U.S. Cl. ..... 269/45; 269/900
(58) Field of Search ..... 269/45, 75, 900, 269/289 R, 296

(56) References Cited

U.S. PATENT DOCUMENTS

| | | | | | |
|---|---|---|---|---|---|
| 260,396 | A | | 7/1882 | Hunt | |
| 307,178 | A | | 10/1884 | Carter | |
| 456,891 | A | | 7/1891 | Fish | |
| 783,031 | A | | 2/1905 | Fell | |
| 1,672,996 | A | | 6/1928 | Wilson | |
| 2,887,974 | A | * | 5/1959 | Weinfeld | 269/45 |
| 3,858,578 | A | * | 1/1975 | Milo | 600/229 |
| 4,606,576 | A | | 8/1986 | Jones | |
| 5,033,528 | A | | 7/1991 | Volcani | |
| 5,276,596 | A | | 1/1994 | Krenzel | |
| 5,318,284 | A | * | 6/1994 | Demmeler et al. | 269/900 |
| 6,173,947 | B1 | * | 1/2001 | Johnson | 269/296 |
| 6,375,177 | B1 | * | 4/2002 | Witte | 269/45 |
| 6,520,495 | B1 | * | 2/2003 | La Mendola | 269/45 |

* cited by examiner

*Primary Examiner*—Robert C. Watson
(74) *Attorney, Agent, or Firm*—Dean A. Craine

(57) ABSTRACT

A hobbyist's tool comprised of a grid-like base member containing a plurality of uniformly shaped and uniformly spaced apart peg openings into which adjustable, flexible arms may be attached. Formed on the lower end of each flexible arm is an elastic bushing designed to fit snugly into one of the peg openings on the base member. Attached to the opposite, upper ends of the flexible arms are clamp, vise, or other retaining members which temporarily hold parts needed to be glued, painted, or otherwise held suspended. The flexible arms are made of a plurality of ball-and-socket joints that enable the part holders to be posed in various orientations and elevations. The flexible arms may be selectively removed and replaced in any of the peg openings on the primary base member to hold different parts. An optional secondary base member is also provided that may be perpendicularly aligned and selectively attached to different locations on the primary base member. The secondary base member also includes a plurality of peg openings formed thereon that enable the flexible arms to be selectively attached thereto for horizontal alignment over the primary base member. An optional panel member placed under the primary base member may be provided for easy recovery of small screws or other small items that inadvertently fall into the peg openings.

13 Claims, 5 Drawing Sheets

WORK HOLDING TOOL SYSTEM

This is a utility patent application based on a provisional patent application (Serial No. 60/308,548) filed on Jul. 27, 2001.

BACKGROUND OF THE INVENTION

1. Field of the Invention

This invention pertains to work holders, and in particular, to adjustable work holders that use a plurality of holders to hold parts in a desired orientation and elevation.

2. Description of the Related Art

Hobbyists who work on model airplanes and the like often work with small parts that need to be glued, painted, tied, popped into place, etc. One drawback of working with small parts is that it can be frustrating to try to find ways to properly secure the parts in position while they are being glued, or to paint or varnish a desired surface and allow it to dry without touching the surface. A hobbyist who needs to paint the underside of a figurine, for example, may hold the figurine in one hand and paint it with the other, then lay it down on a paper towel to dry. This can cause the paint to run or dry unevenly and stick to the paper towel or drying surface.

In the past, a hobbyist who wished to glue parts, such as those used to construct a model airplane, has attached or braced the freshly glued parts together using everyday objects such as rubber bands, paper clips, tape, etc. that the hobbyist happens to have on hand. Attaching or bracing the parts or objects together in this manner is often clumsy, as the everyday objects are poorly suited to properly accommodate the characteristics of the parts. As a result, the parts are often not properly aligned or attached together.

Hobbyists may include children of different ages with different levels of coordination. It is well known that young girls often enjoy combing and styling fashion dolls' hair, which usually requires the use of two hands; one hand used with the comb and the other hand used to hold a bunch of hair or to hold the fashion doll. If the young girl wishes to braid the hair or adorn the hair with bows or barrettes, two free hands are significantly better than one. While a fashion doll stand can hold a doll upright, it is generally not strong enough to withstand the pressure applied to the fashion doll while combing or hairstyling.

Another common problem for hobbyists is keeping track of loose or fallen parts. Such items, especially screws, have a tendency to visually blend into the work surface or roll off the work surface onto the floor.

What is needed is a hobbyist's work holding tool that can address all of the above-described issues. Such a tool must have the ability to selectively hold parts of different shapes and sizes in a suspended manner so that the user may view the part at or near eye level and be able to apply paint, glue, etc. The tool must also have the ability to temporarily hold multiple parts in close alignment for gluing or attachment. The tool should also include means for retaining small parts or accessories that may fall from the suspended parts.

SUMMARY OF THE INVENTION

It is an object of the present invention to provide a hobbyist's work holding tool system that selectively holds parts of different shapes and sizes.

It is an object of the present invention to provide a tool system that allows one or more parts to be positioned at different elevations and orientations and can hold them together for attachment.

It is another object of the present invention to provide a tool system that can be used with a wide variety of different part holders.

It is a further object of the present invention to provide a tool that includes means to retain or catch small parts or accessories that may fall from the suspended parts.

These and other objects of the invention which will become apparent are met by a hobbyist's work holding tool system comprised of a grid-like primary base member into which at least one adjustable, flexible arm may be selectively attached at different locations thereon. In the preferred embodiment, the base member is a planar structure that includes a plurality of equally-spaced-apart, uniformly-shaped, vertically aligned peg openings. The flexible arm includes a longitudinally aligned plurality of interlocking ball and socket joint segments which enable the flexible arm to be twisted and disposed at different angles. The lower end joint segment of each flexible arm includes a peg opening attachment means that enables the flexible arm to be selectively attached to a peg opening. In the preferred embodiment, the peg opening attachment means is an elastic bushing that fits snugly into any one of the peg openings to securely hold the flexible arm in a perpendicular alignment over the base member space. Each bushing includes an optional means for adjusting the cross-sectional area of the bushing so that the user may adjust the fitting of the bushing inside the peg opening. Attached to the opposite, upper end of each flexible arm is an adjustable part holder, such as a clamp, vise, or similar device, which attaches to a desired part so that the flexible arm may be used to hold the part in a desired orientation or elevation.

As stated above, each flexible arm is made of a series of longitudinally aligned, interconnected ball-and-socket joint segments (also called "modular hose" or "beads and pearls" in the doll hobby industry) capable of being selectively connected, detached, twisted and rotated by the user so that the part holder may be disposed at the desired orientation and elevation relative to the base member. The connection between the joint segments is sufficiently tight so that the initial orientation and elevation of the flexible arms is maintained when a part is attached to the part holder. During use, each flexible arm may be selectively attached to different peg openings on the base member so that the spacing between the flexible arm and the work piece may be adjusted.

The system also includes an optional secondary base member capable of being perpendicularly aligned and attached to the primary base member. The secondary base member includes peg openings similar to the peg openings used on the primary base member. During use, the flexible arms may be connected to the secondary base member peg openings to enable them to be horizontally aligned over the primary base member for holding a part.

Disposed below the bottom surface of the primary base member is an optional panel member used to close the peg openings and catch small screws or other small items that fall into the peg openings. During use, the peg openings on the primary base member also may be used to temporarily store unused parts or accessories.

DESCRIPTION OF THE PREFERRED EMBODIMENT(S)

Figure 3:
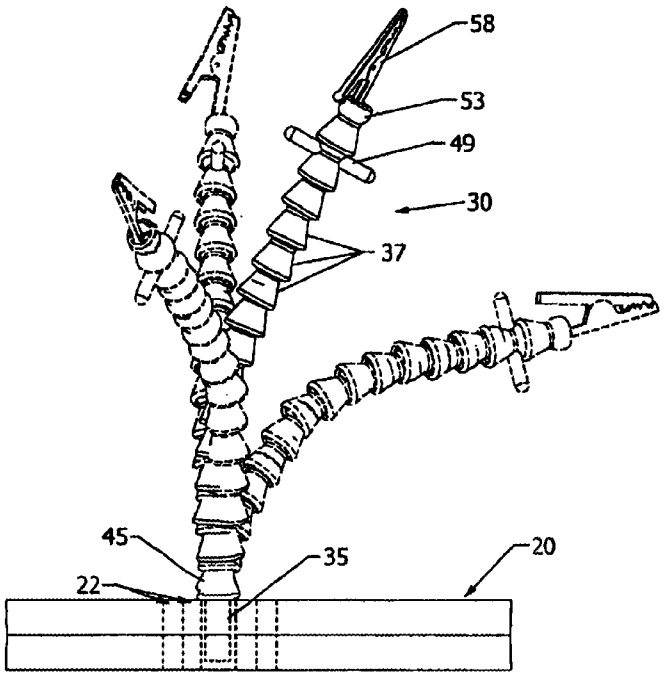
FIG. 3 is an end elevational view of the system.
Figure 4:
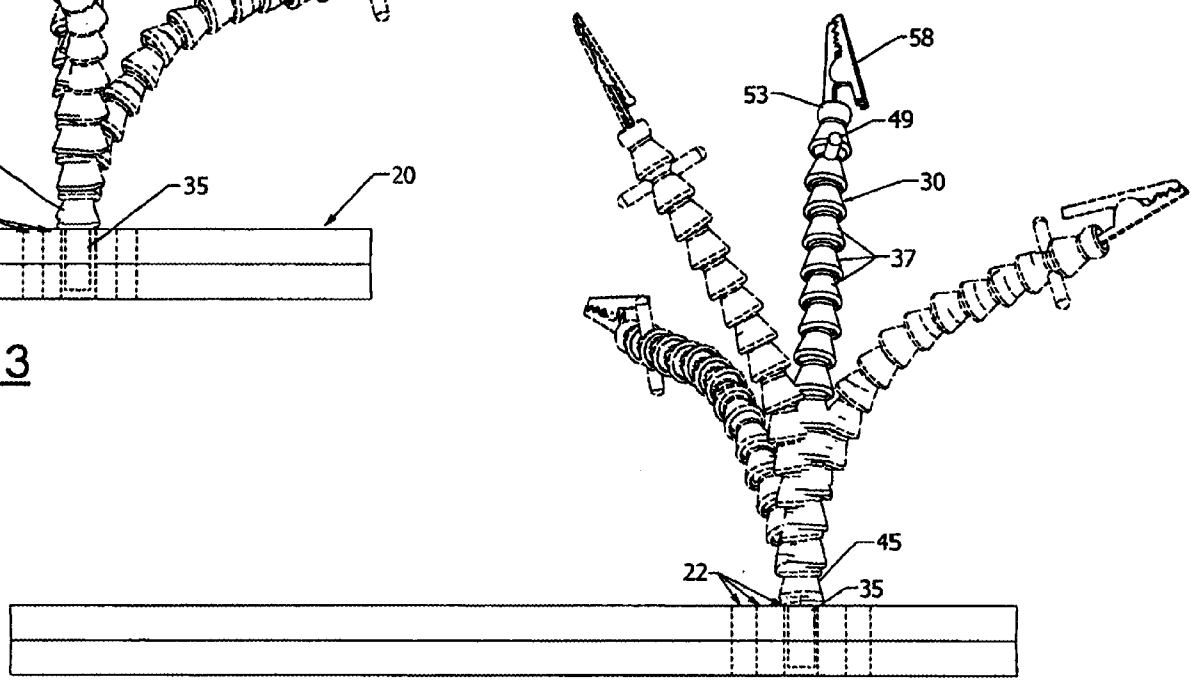
FIG. 4 is a front elevational view of the invention.

Referring to the accompanying FIGS., there is shown and described a hobbyist's work holding tool 10 comprised of a grid-like primary base member 20 into which a plurality of adjustable, flexible arms 30 may be selectively attached. In the preferred embodiment, the base member 20 is a planar structure that includes a plurality of small, square-shaped vertically aligned peg openings 22. As shown in FIGS. 3 and 4, the lower end of each flexible arm 30 includes an elastic bushing 35 that fits snugly into one of the peg openings 22 formed on the base member 20. Attached to the opposite, upper end of each flexible arm 30 is an adjustable part holder 58, such as an alligator clip, C-clamp, vise, or similar device which holds a desired part in a suspended position over the base member 20.

Figure 5:
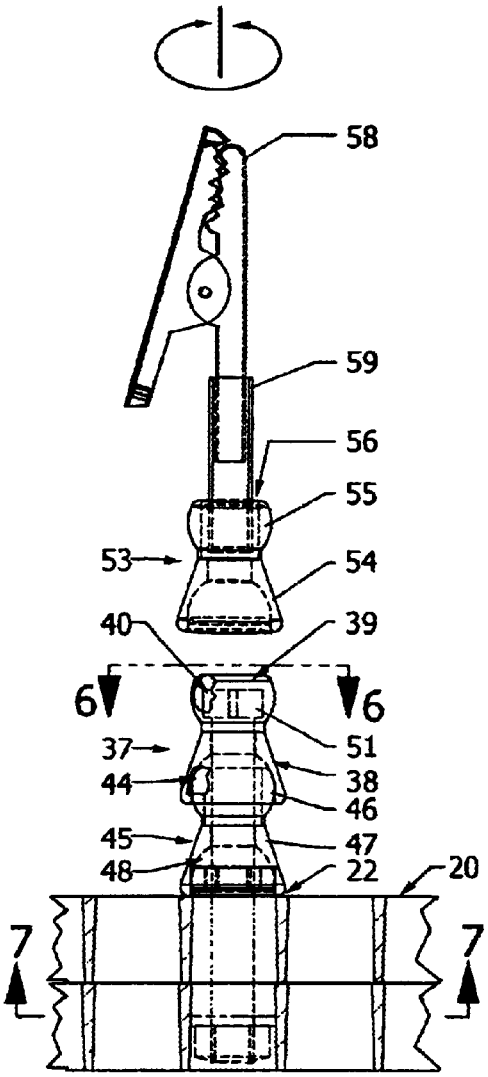
FIG. 5 is a sectional side elevational view of the flexible arm in the base member.
Figure 6:
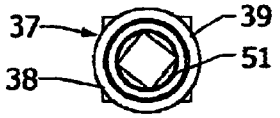
FIG. 6 is a top plan view of the flexible arm taken along line 6—6 in FIG. 5.
Figure 7:
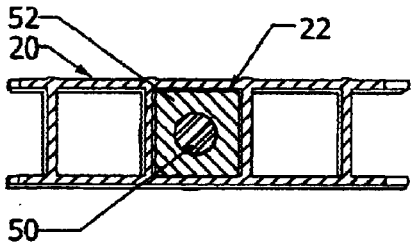
FIG. 7 is a bottom plan view of the flexible arm taken along line 7—7 in FIG. 5.

The flexible arms 30 are made of a series of longitudinally aligned, interconnected ball-and-socket joint segments 37 capable of being independently twisted and rotated so that the flexible arm 30 may be disposed at any desired orientation as shown in FIGS. 1–4. As shown in FIGS. 5–7, each joint segment 37 includes a lower socket body 38 and an integrally formed upper ball body 39. Formed inside the lower socket body 38 is a half-spherical void 44 designed to snap-fit around the upper ball body 39 on a lower, adjacent joint segment (not shown) or the upper ball body 46 on an end joint segment 45. The fitting between the lower socket body 38 and upper ball body 39 is sufficiently tight so that the flexible arm 30 remains in its original orientation when a part weighing up to approximately two ounces is attached to the part holder 58.

Each flexible arm 30 includes a lower end joint segment 45 similar to the ball and socket joint segment 37 discussed above with an upper ball body 46 and a lower socket body 47. Longitudinally aligned and attached to the lower socket body 47 is the elastic bushing 35 mentioned above which is longitudinally aligned and disposed tightly into a peg opening 22 on the base member 20.

In the preferred embodiment, the bushings 35 are approximately the same length as the peg opening 22 and square in cross-section as shown in FIG. 5. The bushing 35 is attached to the section of longitudinally aligned bolt 50 that extends from the lower end joint segment 45. The head 51 of the bolt 50 is located inside the void space 40 formed inside the upper ball body 39. During use, a first nut 52 is attached to the end of the bolt 50 which is tightened to fit tightly into the void space 48 formed inside the lower socket body 47. Attached to the end of the bolt 50 after the bushing 35 is attached to the bolt 50 is a second nut 57 that is tightened or loosened thereby applying or relieving pressure on the distal end of the bushing 35 to change the diameter or cross-sectional area of the bushing 35. By changing the cross-sectional area of the bushing 35, the user is able to adjust the fitting of the bushing 35 on the sides of the peg opening 22.

Each flexible arm 30 also includes an upper end joint segment 53 which is used to selectively attach the part holder 58 to the flexible arm 30. The upper end joint segment 53 includes a lower socket body 54 designed to snap-fit and connect to the upper ball body 39 on the joint segment 37. Formed on the opposite end of the upper end joint segment 53 is a tool receiver portion 55 that receives the part holder 58. In the preferred embodiment, the tool receiver portion 55 includes a bore 56 that receives a post member 59 formed on the part holder 58. A suitable adhesive may be used to attach the post member 59 to the tool receiver portion 55. As shown in FIGS. 1–4, optional handle members 49 may be attached to the flexible arms 30 that enable the user to more easily twist and turn them.

In the preferred embodiment, the flexible arm 30 is made up of fifteen joint segments 37 with each joint segment 37 measuring approximately ¾ inch in length. The upper ball body 46 measures approximately ¼ inch in length and ½ inch in diameter. The lower socket body 47 is approximately ½ inch in length and ⅝ inch in diameter.

Figure 8:
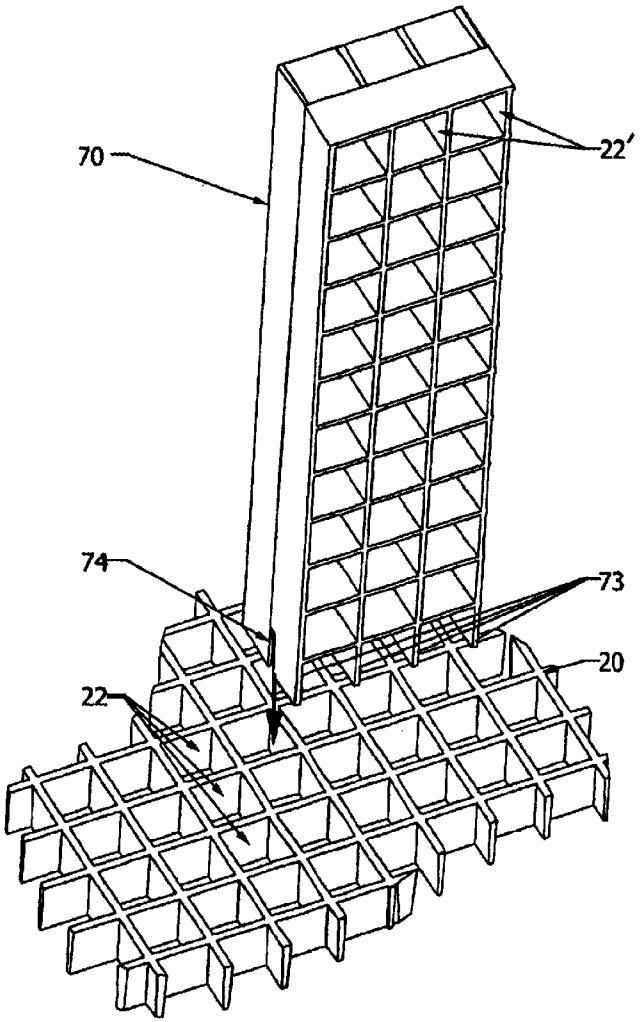
FIG. 8 is a perspective view of the secondary base member.

The system 10 also includes a secondary base member 70 capable of being selectively attached to the primary base member 20. The secondary base member 70, shown more clearly in FIG. 8, has a plurality of evenly-spaced-apart peg openings 22' formed thereon. The peg openings 22' are identical to the peg openings 22 formed on the primary base member 20. Formed on the lower end of the secondary base member 70 are four longitudinally aligned parallel legs 73 that can be inserted into six adjacent peg openings 22 located on the primary base member 20. The legs 73 are aligned transversely on the end surface of the secondary base member 70 with a longitudinally aligned slot 74 centrally formed therein that allows the legs 73 to extend into adjacent peg openings 22 on the primary base member 20.

Figure 1:
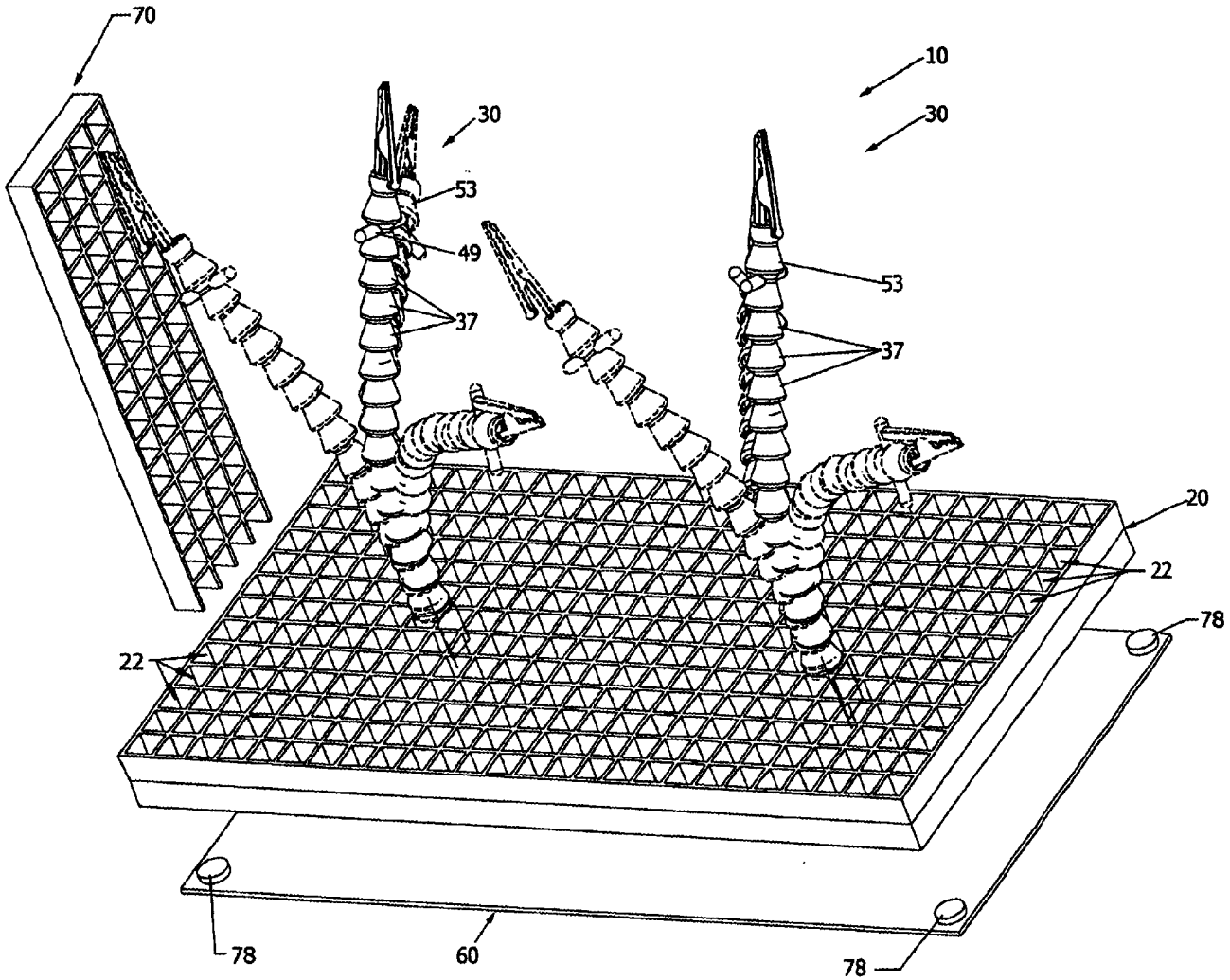
FIG. 1 is a perspective view of the work holding tool system disclosed herein.
Figure 2:
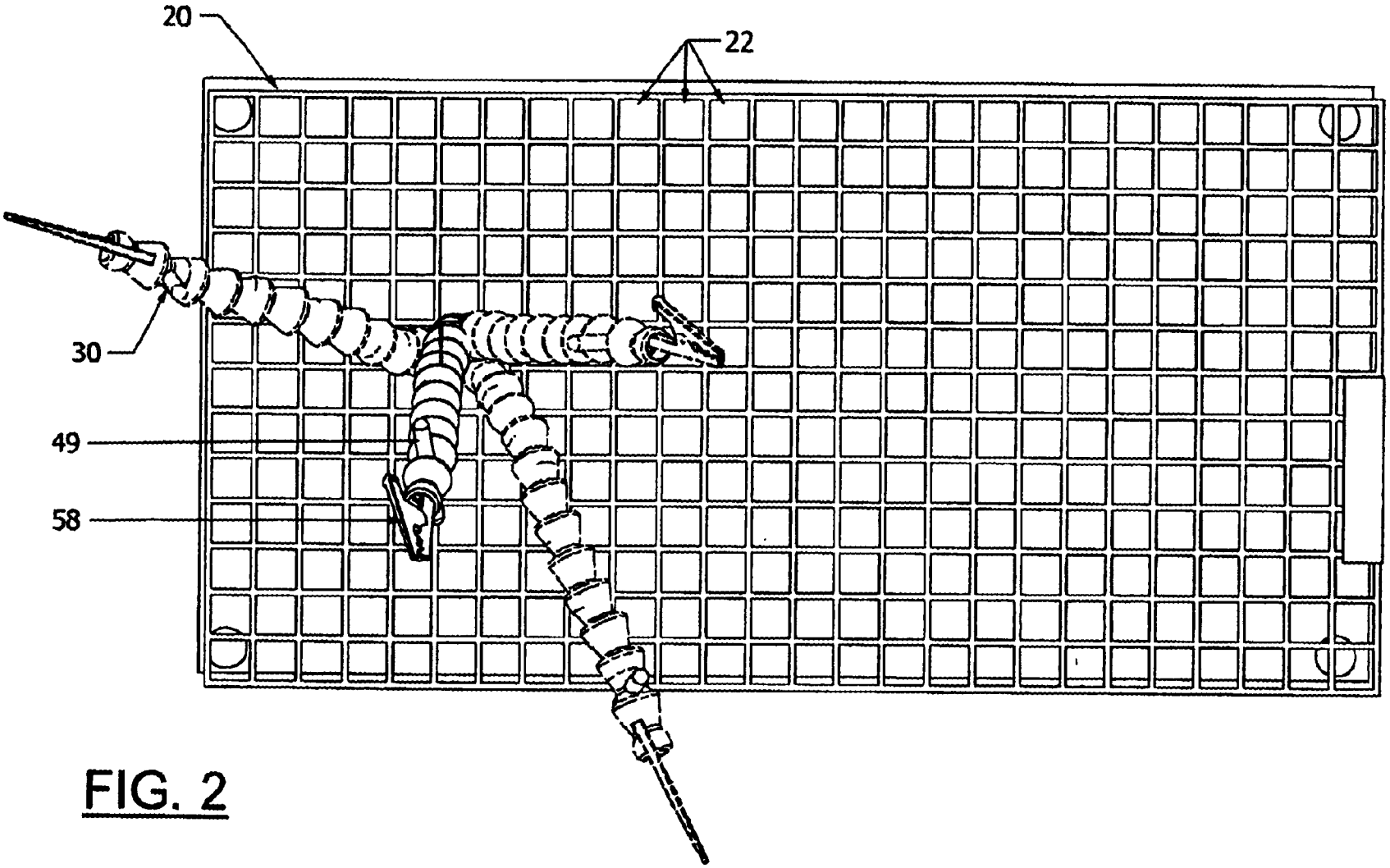
FIG. 2 is a top plan view of the system.

In the preferred embodiment, the peg openings 22 formed on the primary base member 20 are hollow. As shown in FIG. 1, disposed below the primary base member 20 is an optional panel member 60 used to store unused parts and accessories or to prevent small screws or other small items from becoming lost on the floor after inadvertently falling from the suspended parts. The panel member 60 may be permanently attached to the bottom surface of the base member 20 or selectively attached to the corners of the base member 20 via raised projections 78 that are inserted into the corner peg openings 22.

In the preferred embodiment, the primary base member 20 measures approximately 7½ inches in width, approximately 15 inches in length, and approximately 1 inch in height. The secondary base member 70 is rectangular-shaped, approximately 1 inch in width, approximately 2 inches in length, and approximately 7 inches in height. Each leg 73 is approximately ½ inch in length. Each peg opening 22, 22' is square in cross-section, measuring approximately ½ inch on each side. In the preferred embodiment, both the primary and secondary base members 20, 70, respectively, are made of lightweight, rigid, thermoplastic material.

In compliance with the statute, the invention described herein has been described in language more or less specific as to structural features. It should be understood, however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A work holding tool system, comprising:

a. a primary base member having a plurality of peg openings formed thereon;

b. at least one flexible arm member including a plurality of longitudinally aligned, interlocking ball-and-socket joint segments enabling said flexible arm member to be twisted and disposed at different angles, and selectively adjusted in length, said flexible arm member including an upper end joint segment and a lower end joint segment;

c. an adjustable part holder attached to said upper end joint segment of said flexible arm member; and, d. means attached to said lower end joint segment for selectively attaching said flexible arm to one of said peg openings on said base member.

2. The work holding tool system, as recited in claim 1, further including a panel member located under said primary base member.

3. The work holding tool system, as recited in claim 2, wherein said panel member is removably attached to said primary base member.

4. The work holding tool system, as recited in claim 1, further including a secondary base member perpendicularly aligned over said primary base member, said secondary base member having a plurality of peg openings capable of receiving said means for selectively attaching said flexible arm to attach said flexible arm thereto.

5. The work holding tool system, as recited in claim 4, wherein said secondary base member includes a pair of longitudinally aligned legs that fit into a pair of said peg openings formed on said primary base member to hold said secondary base member in a perpendicularly aligned position on said primary base member.

6. The work holding tool system, as recited in claim 1, wherein said peg opening attachment means is an elastic bushing that fits snugly into said peg opening.

7. The work holding tool system, as recited in claim 6, further including means for adjusting the cross-sectional area of said bushing to selectively adjust the force of said bushing inside said peg opening.

8. The work holding tool system, as recited in claim 4, further including a panel member attached to said primary base member.

9. The work holding tool system, as recited in claim 1, wherein said adjustable part holder is a clamp.

10. A work holding tool system, comprising:

a. a primary base member having a plurality of evenly-spaced-apart peg openings;

b. at least one flexible arm member including a plurality of longitudinally aligned, interlocking ball-and-socket joint segments enabling said flexible arm member to be twisted and disposed at different angles, said flexible arm member including an upper end joint segment and a lower end joint segment;

c. an adjustable part holder attached to said upper end joint segment of said flexible arm member wherein said adjustable part holder is a clamp;

d. means attached to said lower end joint segment for selectively attaching said flexible arm to one of said peg opening on said base member wherein said peg openings attachment means for attaching said flexible arm to one of said peg openings is an elastic bushing that fits snugly into said peg opening; and, e. a panel member attached to said primary base member.

11. The work holding tool system, as recited in claim 10, further including means for adjusting the cross-sectional area of said bushing to selectively adjust the force of said bushing inside said peg opening.

12. The work holding tool system, as recited in claim 10, further including a panel member attached to said primary base member.

13. A work holding tool system, comprising:

a. a primary base member having a plurality of peg openings formed thereon;

b. at least one flexible arm member including an upper end joint segment and a lower end joint segment;

c. an adjustable part holder attached to said upper end joint segment of said flexible arm member; and, d. an elastic bushing attached to said lower end joint segment for selectively attaching said flexible arm to one of said peg openings on said base member.

* * * * *